United States Patent [19]

Anderson et al.

[11] 4,075,383

[45] Feb. 21, 1978

[54] METHOD OF PATTERN BONDING A NONWOVEN WEB

[75] Inventors: Richard M. Anderson, Raleigh; Alton L. Caviness, Durham; Virginia C. Menikheim, Chapel Hill; Bernard Silverman, Raleigh, all of N.C.

[73] Assignee: Monsanto Company, St. Louis, Mo.

[21] Appl. No.: 677,183

[22] Filed: Apr. 15, 1976

[51] Int. Cl.[2] ..... B32B 7/14

[52] U.S. Cl. ..... 428/198; 428/219; 264/83; 264/119

[58] Field of Search ..... 264/83, 119; 428/198, 428/219

[56] References Cited

U.S. PATENT DOCUMENTS

| | | | |
|---|---|---|---|
| 3,150,416 | 9/1964 | Such | 264/128 |
| 3,676,244 | 7/1972 | Kim | 156/181 |
| 3,853,659 | 12/1974 | Rhodes | 264/83 |

*Primary Examiner*—Robert F. White

*Assistant Examiner*—James R. Hall

*Attorney, Agent, or Firm*—Donald J. Fitzpatrick

[57] ABSTRACT

The method of pattern bonding nonwoven webs made from polyamide filaments wherein the web is exposed in a first treatment zone to a gaseous mixture of an activating agent and water and is then exposed in a second treatment zone to a wet atmosphere to allow the web to absorb enough additional moisture so that the web becomes essentially unbondable when pressed at room temperature. The web is then passed between a pair of rolls, at least one of which is embossed or engraved and heated to a sufficient temperature to autogenously bond discrete portions of the web while leaving the remainder of the web essentially unbonded. The high molar ratio of water to activating agent in the outer portions of the filaments in the web will prevent bonding of the web in those areas not contacted by the embossed roll, so that the web will have a high tenacity plus good drape and hand characteristics.

14 Claims, 4 Drawing Figures

METHOD OF PATTERN BONDING A NONWOVEN WEB

BACKGROUND OF THE INVENTION a. Field of the Invention

This invention relates to methods for pattern bonding nonwoven webs made from polyamide filaments.

b. Description of the Prior Art

Various methods of bonding nonwoven webs are known. For example, U.S. Pat. No. 3,647,591 discloses a process for bonding the entire area of a nonwoven web made up of a blend of nylon fibers and fibers of another kind which are not affected by a strong acid such as hydrochloric acid. The acid is applied to the web from an aqueous solution by spraying or dipping, with the fabric then being hot calendered to bond the nylon filaments in the web together. Under these conditions, the acid dissolves the nylon filaments so that these filaments more or less serve as an adhesive which bonds the filaments in the web together, the other filaments in the web providing strength.

U.S. Pat. No. 3,676,244 to Kim discloses a process for bonding the entire area of a web made from polyamide filaments wherein the web is passed through a preconditioning zone such that the web picks up from 3 to 6 weight percent of water, with the web then being passed through a second zone where the web absorbs a hydrogen halide gas and additional moisture. The purpose of the preconditioning step is to allow the web to pick up the gas at a higher rate. The web is then self-bonded by washing it in water at room temperature to remove the absorbed gas.

U.S. Pat. No. 3,516,900 to Mallonee et al discloses a process for bonding the entire area of a polyamide nonwoven fabric by exposing the fabric to gaseous hydrogen halide or boron trifluoride and then removing the activating gas from the fabric by either washing at room temperature or heating.

Nonwoven fabrics which are bonded over the entire fabric area have poor drapability and are usually stiff and papery. Such nonwoven fabrics are unsuited for many end uses where the physical characteristics of a conventional fabric are required. It is known that nonwoven fabrics have better drape and hand if only spaced, discrete areas of the fabric are bonded. This fabric is made by a process known as "pattern bonding".

In some pattern bonding processes the bonding is achieved by the application of an adhesive to discrete, spaced areas of the fabric. Disadvantages of this process are that a foreign material is introduced into the fabric and it is difficult to control lateral migration of the adhesive while achieving penetration of the web. Also, adhesive buildup on the process equipment may be a problem.

In another pattern bonding method the nonwoven fabric is pressed between a pair of rolls, at least one of which is embossed and heated to such a temperature that, in discrete areas of the fabric, roll pressure and heat compacts and melts the fibers of the web together. Unfortunately, as in U.S. Pat. No. 3,855,045, when the roll is hot enough to assure a strong bond in the bonded area, a certain amount of bonding will occur in the remainder of the fabric. Thus, the drape and hand of the fabric will be somewhat impaired. Some of the bonds in the uncompacted area of the fabric can be broken by working the fabric, but this adds another step to the process.

Ideally, the pattern bonded fabric will have discrete bonded areas with little or no bonding in the remainder of the fabric. Such a fabric will have a high tenacity but will still have good drape and hand.

SUMMARY OF THE INVENTION

The method for pattern bonding a nonwoven fabric made from polyamide filaments wherein the fabric is exposed in a first treatment zone to an activating agent, in gaseous form, preferably in the presence of water vapor, the fabric then being passed through a second treatment zone where it sorbs sufficient additional water vapor to raise the molar ratio of water to activating agent in the bonding annulus of the fibers in the fabric to at least about 2, the fabric being essentially unbondable under these conditions when pressed at room temperature. The fabric is then passed between a pair of rolls, at least one of which is embossed and heated sufficiently to autogenously bond discrete portions of the fabric. The high molar ratio of water to activating agent will prevent bonding in those areas of the fabric not contacted by the embossed roll, so the fabric will have a high tenacity but will also have good drape and hand.

DETAILED DESCRIPTION OF THE INVENTION

Figure 1:
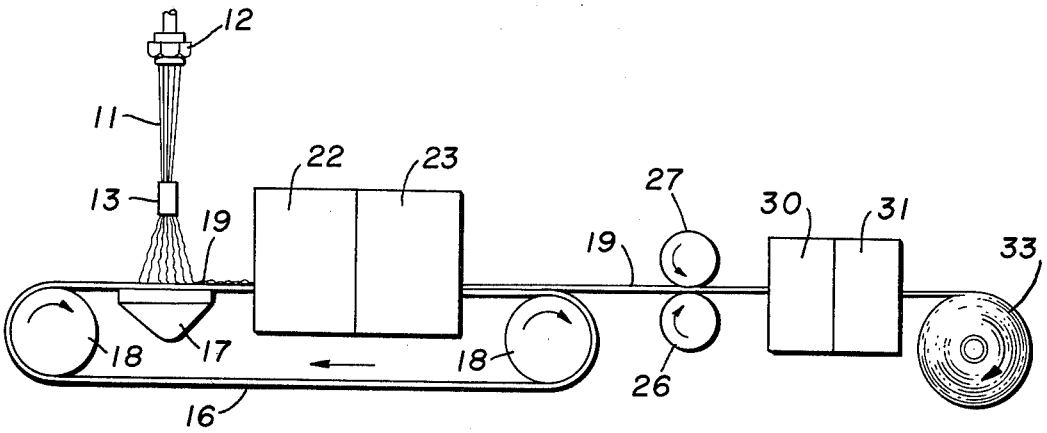
FIG. 1 is a schematic side view showing apparatus useful in carrying out the process of the present invention.

Referring now in detail to the drawing, there is shown in FIG. 1 an apparatus for carrying out the process of the present invention. Polyamide filaments 11 formed by a conventional spinnerette 12 are attenuated by an air nozzle or attenuator 13 and blown onto a porous belt 16, a suction box 17 positioned below the belt 16 retaining the filaments 11 on the belt 16. The filaments are collected on the belt 16 in the form of a nonwoven web 19. This structure and operation is conventional.

The belt 16 is mounted on and moved by rolls 18 to carry the web or fabric 19 formed by the filaments through first and second treatment treatment zones 22 and 23, respectively. In the zones 22 and 23 the web or fabric 19, in an unbonded condition, is exposed to gaseous atmospheres which condition the web for the pattern bonding step which is to follow. The zones 22 and 23 are chambers which may be constructed in the manner illustrated in U.S. Pat. No. 3,676,244. However, the structure of the chambers is not critical and chambers other than those used in U.S. Pat. No. 3,676,244 may readily be used.

In the first zone or chamber 22 the web 19 is gassed by exposure to an activating gas made up of a mixture of water vapor and an activating agent such as hydrogen chloride in gaseous form. It is not critical that water vapor be used here but it is preferred since water vapor enhances the sorption rate of the agent by the web. In this chamber the surfaces of the filaments in the web will sorb hydrogen chloride and water in a molar ratio of about 1 to 1 over a wide range of gas compositions. Generally, the atmosphere in the chamber 22 and the dwell time of the web 19 in the chamber 23 should be such that the web picks up 0.1 to 20 weight percent of HCl in this chamber. However, it is preferred that the amount of HCl absorbed by the web in the chamber 22 be 0.5 to 6 weight percent. If the web 19 exiting from the chamber 22 is pressed at normal room temperature and humidity it will be bondable.

The term "activating agent" used herein refers to any agent which will, in gaseous form, effect an autogenous bonding of the polyamide filaments as described in U.S. Pat. No. 3,516,900 to Mallonee et al. Examples of such effective activating agents are the hydrogen halides, boron trifluoride, sulfur dioxide, sulfur trioxide, and a mixture of chlorine and sulfur dioxide. Hydrogen chloride is the preferred activating agent.

The process of this invention is operative with polyamide filaments of filaments which have a polyamide surface portion. The process is thus suitable for bonding webs made from monocomponent polyamide filaments, side-by-side bicomponent filaments where one component is polyamide and sheath/core filaments where the sheath component is polyamide. The bonding of nylon by this process is an example of a general case in which the polymer may be any composition containing a high degree of hydrogen bonding whose hydrogen bonds may be disrupted by the sorption of an activating agent system (e.g., $H_2O$ + HCl in the polyamide example), followed by sufficient desorption of the system to reform the hydrogen bonds.

The web 19 then passes through the second zone or chamber 23 where it is post conditioned by exposure to a high-humidity atmosphere in such a manner that the web will absorb additional water. The amount of water absorbed in the chamber 23 should be such that the molar ratio of water to HCl in the web leaving the chamber 23 is above about 2–2.5 to 1 in the bonding annulus of the filaments making up the web. When the web has absorbed water vapor and HCl in this molar ratio, it will be essentially unbondable when pressed at room temperature. The terms "filament annulus" and "bonding annulus" refer to the outer portion of each filament in the web, this portion amounting to from less than 1 percent to about 65 percent of the cross sectional area of the filament.

Figure 2:
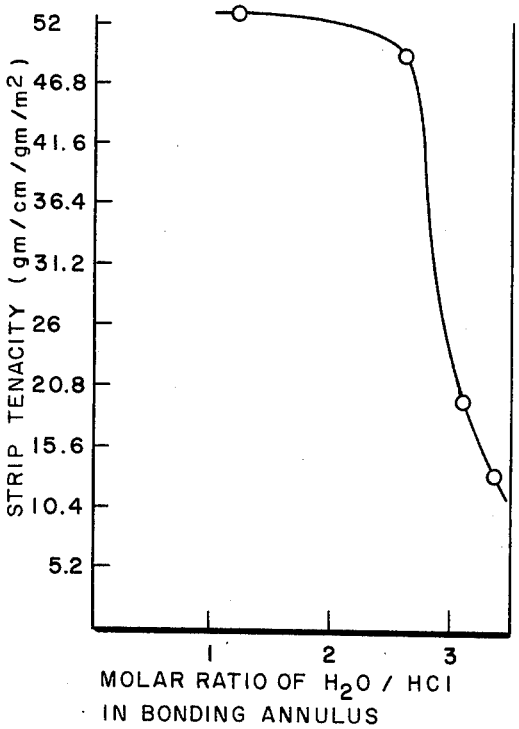
FIG. 2 is a graph showing the ratio of water to activating agent in the bonding annulus of the fiber necessary to render the fabric essentially unbondable when pressed at room temperature, plotted as strip tenacity versus molar ratio.

FIG. 2 is a graph illustrating the effect of increasing the molar ratio of water to HCl in the bonding annulus to above about 2. The curve shown in this graph was obtained by pressing samples of nonwoven polyamide webs containing various molar ratios of water and HCl at room temperature. These webs were passed between smooth steel rolls at room temperature, using a pressure of 17.86 Kg per linear centimeter of roll contact with the web. The curve shows that the tenacity of the pressed web, which is a direct indication of the amount of bonding in the web, remains relatively high until the molar ratio of water to HCl in the bonding annulus exceeds, in this case, about 2.5. When the molar ratio of water to HCl exceeds this value, the tenacity of the web drops substantially. The addition of sufficient water in the chamber 23 to raise the molar ratio of water to HCl above about 2–2.5 insures that little or no bonding of the web will occur when the web is pressed at room temperature. HCl sorbed polyamide filaments quickly sorb moisture when the filaments are exposed to a high-humidity atmosphere and readily achieve the desired molar ratio of over about 2–2.5.

Figure 4:
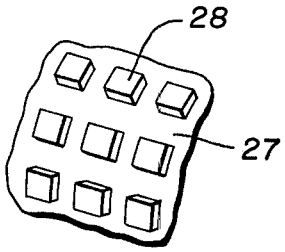
FIG. 4 is a fragmentary perspective view of the surface of the embossed roll, showing the raised portions on the surface of the roll.

After passing through the second treatment zone 23, the web or fabric 19 is passed between rolls 26 and 27 positioned to nip and press the moving fabric. The roll 27 is heated and has an embossed or engraved surface. The surface of the roll 27 is embossed in such a manner that it has raised portions 28 (FIG. 4) which contact and apply heat and pressure to discrete portions of the web 19, the remainder of the surface of the roll 27 remaining out of operative contact with the web.

The roll 27 is heated sufficiently so that the raised portions 28 thereof drive off some of the water in the discrete portions of the web contacted by these raised portions to compact and effect bonding in these web portions. The amount of water driven off in these areas or web portions should be such that the final molar ratio of water to activating agent in the bonding annulus of the fibers in these areas is below about 2. Otherwise, bonding may be poor. Since the remainder of the web remains out of operative contact with the heated roll 27, little or no bonding occurs in the remainder of the web. Thus, the web, after passing between the rolls 26 and 27, will have compacted bonded areas arranged in a pattern, with the remainder of the web being essentially unbonded. The size, shape, and spacings of the bonded areas of the web will be determined by the surface configuration of the embossed roll 27.

The pattern of the raised portions on the roll 27 is not critical. The combined area of the raised portions 28 will be 2 to 80 percent of the area of the roll, and preferably 5 to 25 percent of the roll area. The number of raised portions per square centimeter may be 1 to 100, and is preferably 16 to 64.

The weight of the web or fabric 19 may be 4 to 400 grams per square meter, and is preferably 10 to 150 $gm/m^2$.

Upon making a number of runs it was found that the almost vertical portion of the curve shown in FIG. 2 occurs between $H_2O$/HCl molar ratios of about 2 to 3.5. In some cases it was as low as 2 and in other cases as high as 3.5. It is believed that the reason for this variation from 2 to 3.5 is caused by migration of some of the water toward the inner portions of the polyamide filaments, thereby lowering the actual molar ratio of water to agent in the outer portions or the bonding annuli of the filaments. The reasons for the unbondability of the web above these molar ratios is believed to be that, above these molar ratios, enough of the hydrogen bonds in the polyamide structure are disrupted and the structure sufficiently "plasticized" that the surface of the filament passes beyond a tacky stage to a less viscous, non-adhering stage.

It is not possible to determine the molar ratio of water to agent in the annulus of a filament without considering the core of the filament. When the molar ratio is determined, it is assumed that water present in the filaments prior to gassing is uniformly distributed throughout the filament and that water and activating agent sorbed in the subsequent steps is in the filament annulus. In view of the short time interval between gassing and pressing it is reasonable to assume that most of the water and activating agent added in gassing and post conditioning is in the annuli of the filaments entering the nip of the rolls 26 and 27.

The molar ratio of $H_2O$/activating agent at which the almost vertical portion of the curve shown in FIG. 2 occurs might be called the "bonding limit", since at molar ratios above this value little or no bonding occurs in the web when it is pressed at room temperature and at a roll pressure of 17.86 Kg/cm.

It is not fully understood why the level of moisture necessary to achieve the desired molar ratios can best be attained after the activating gas has been applied to the web. During exposure to the activating agent/water gas mixture, the filament annulus sorbs HCl and additional $H_2O$, readily attaining a pickup of 0.1 to 20 weight percent of the agent, at a molar ration of water/activating agent of about 1:1. Typically, the filament annulus sorbs water and activating agent on a molar ratio of about 1:1 from the activating gas mixture. However, the gassed web can rapidly sorb the additional required $H_2O$ from the humid atmosphere in the second chamber 23.

By "unbondable" we mean that the bonding achieved when the web is passed between two steel rolls under a pressure of 17.86 Kg per linear cm of roll contact, with the rolls and web being at 21° C, is below acceptable levels. For practical purposes a web having an acceptable bonding level will have a strip tenacity of not less than 50–70 percent of the strip tenacity of the same web after being passed between rolls heated to about 65° C and at the same pressure. Normally, the strength of the unbondable web pressed by unheated rolls is about 10–40 percent of a like web pressed by hot rolls.

Figure 3:
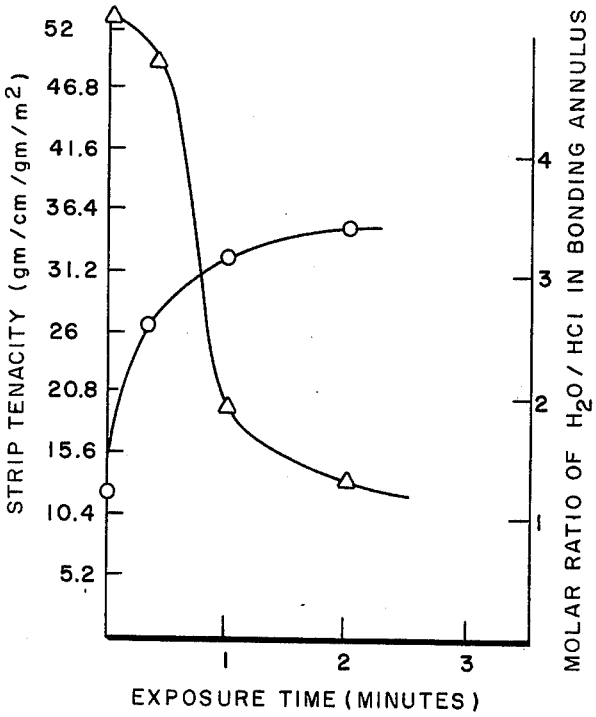
FIG. 3 is a graph showing $H_2O/HCl$ molar ratios in the bonding annuli of the filaments and strip tenacity plotted against time of exposure of a nonwoven web of polyamide filaments to an atmosphere containing moisture.

FIG. 3 shows $H_2O$/HCl molar ratios in the filament annulus and strip tenacities plotted against time of exposure to a humid atmosphere. These curves were obtained by exposing samples to a gaseous mixture of water and HCl to allow the sample to absorb water and HCl to a molar ratio of about 1:1 in the filament annulus and thereafter exposing the samples to an atmosphere of about 76 percent relative humitidy such that the samples after exposure to the humid atmosphere had varying molar ratios of water to HCl in the bonding annuli of the filaments. The samples were then passed between two steel rolls at a temperature of about 21° C and a pressure of 17.86 Kg per linear cm of roll.

It will be noticed from FIG. 3 that the molar ratio of $H_2O$ to HCl rose rapidly to a ratio of about 3.25 and at the same time the strip tenacity decreased from about 53.3 to about 18.8 gm/cm/gm/meter$^2$. Upon continued exposure to the wet atmosphere the molar ratio then rose slowly to about 3.4, at which point the strip tenacity had dropped to about 13.6 gm/cm/gm/m$^2$. The dropping of the strip tenacity to this value indicates that there has been a great reduction in bonding occuring in the sample when pressed at room temperature.

After passing between the rolls 26 and 27 the web is passed through a third zone or chamber 30 where the fabric is washed to desorb the activating agent from the web. The web is then passed through a fourth zone or chamber 31 where it is dried. The web is then taken up on a roll 33.

COMPARATIVE EXAMPLE I

A nonwoven web made up of polyamide filaments was passed through a gassing chamber where it was exposed to an atmosphere containing 0.5 percent HCl and 0.83 percent water vapor by volume. The exposure time of the web was 5 seconds and the web picked up 1.7 weight percent of HCl. Immediately after leaving the gassing chamber, the web was passed between a pair of smooth steel rolls at room temperature and under a pressure of 17.86 Kg per linear cm of roll. After pressing, the web had a strip tenacity of 28.5 gm/cm/gm/m$^2$, a zero span tenacity of 82.1 gm/cm/gm/m$^2$, and a bending length of 3.38 cm.

EXAMPLE II

Example I was repeated with the exception that after the gassing step the fabric was passed through a chamber and exposed to air having a relative humidity of 75 percent to allow the fabric to absorb sufficient additional moisture to reach an unbondable condition. The fabric was then pressed in the manner described in Example I and had strip tenacity of 2.39 gm/cm/gm/m$^2$, a zero span tenacity of 88.1 gm/cm/gm/m$^2$ and a bending length of 2.1 cm. The very low strip tenacity of this example, compared to the strip tenacity of the same in Example I illustrates that the addition of more water following the gassing step effectively prevents bonding of the fabric at room temperature.

EXAMPLE III

Several runs were made to show the loss of water from a nylon web when hot pressed. Nylon webs having a weight of 33.85 gms per square meter which had been preconditioned to equilibrium at 65 percent RH were exposed to a gas stream containing water and HCl in vapor form to allow the webs to absorb HCl and additional moisture and then post conditioned by exposure to 60–62 percent RH air at 21° C for 3 minutes. The webs were then pressed at various speeds between rolls heated to a temperature of 100° C. Table 1 shows the amounts of HCl and water sorbed and lost during this process.

Table 1

| Roll Speed m/min. | $H_2O$ after Preconditioning wt. percent | After gassing and Post Conditioning Wt. % $H_2O$ | Wt. % HCl | After Pressing Wt. % $H_2O$ | Wt. % HCl | Lost In Pressing Wt. % $H_2O$ | Wt. % HCl | Molar Ratio $H_2O$/HCl |
|---|---|---|---|---|---|---|---|---|
| .305 | 4.44 | 7.32 | 3.42 | 3.22 | 2.49 | 4.10 | 0.93 | 8.9 |
| 1.22 | 3.43 | 5.65 | 3.16 | 2.24 | 2.84 | 3.42 | 0.32 | 21.7 |
| 3.66 | 4.44 | 7.32 | 3.42 | 4.22 | 2.89 | 3.10 | 0.53 | 11.9 |

Table 1 shows that little of the agent is lost from the web during hot pressing while a large percentage of water is driven off. The loss of the water lowers the molar ratio of water to agent in the web, making the web bondable. Water is driven off those areas of the web contacted by the hot embossed roll resulting in good bonding in those areas, whereas little or no bonding occurs in those portions of the web not contacted by the embossed roll. The web will have a high tenacity together with good drape and hand characteristics.

EXAMPLE IV

To illustrate the effect that additional moisture has on a nonwoven nylon web which has been exposed to an $H_2O/HCl$ atmosphere the following runs were made. Nylon webs having a weight of 33.9 gm/m² were preconditioned to equilibrium at 65 percent RH and were then exposed for 150 seconds to a gas stream containing 0.24 percent HCl and 0.60 percent water, resulting in an absorption of 3.9 weight percent of HCl.

The webs were then exposed for various time intervals to an air stream at 24° C and a relative humidity of 76 percent to allow the webs to pick up additional moisture prior to pressing. The webs, containing different annular molar ratios of $H_2O$ to HCl were then passed between smooth rolls at 2.7 meters per minute, the roll pressure being 17.86 Kg/cm and the roll temperature being 25° C. The results are shown in Table 2, as runs A, B, C and D.

Table 2

| Runs | Exposure time (seconds) | Molar Ratio before pressing ($H_2O/HCl$) | Strip Tenacity (gm/cm/gm/m²) |
|---|---|---|---|
| A | 0 | 1.18 | 54.4 |
| B | 20 | 2.55 | 56.6 |
| C | 60 | 3.12 | 20.2 |
| D | 120 | 3.37 | 13. |
| E | 120 | 3.37 | 48.5 |

It will be readily apparent that increasing the molar ratio of $H_2O$ to HCl in the bonding annulus increases the resistance of the web to the bonding at room temperature. between molar ratios of 2.55 and 3.12, the strip tenacity dropped from 56.6 to 20.2 gm/cm/gm/m².

In Run E the web was pressed between rolls heated to 150° C, rather than room temperature rolls. Heated to this temperature the rolls were sufficiently hot to make the web bondable resulting in a strip tenacity increase to 48.5 gm/cm/gm/m².

EXAMPLE V

To illustrate the effect of this process a fiber containing a non-polyamide portion, a 33.9 gm/m² web of a 50/50 nylon 66/polyester sheath/core fiber was preconditioned to equilibrium at 23° C and 76 percent RH, exposed to a gas stream containing 0.24 percent HCl and 0.84 percent water for sufficient time for the web to sorb 1.25 weight percent HCl. The web was then exposed to a 24° C, 75 percent RH air stream to allow it to sorb additional water required for this process. The post conditioned web was pressed between an embossed roll heated to 150° C and an unheated resilient roll at a nip velocity of 15 meters per minute. After desorption and drying the web was found to be soft and drapable and had a tenacity of 52.3 gm/cm/gm/m².

What is claimed is:

1. The method of pattern bonding a nonwoven web made from polyamide filaments, comprising
   a. advancing the web through first and second treatment zones,
   b. applying an activating agent to the web in the first treatment zone to allow the web to absorb 0.1 to 20 weight percent of the activating agent,
   c. applying sufficient water in vapor form to the web in the second treatment zone to render the web unbondable when pressed at room temperature,
   d. advancing the web between a pair of rolls at least one of which has raised portions which contact portions of the web, said raised portions being heated sufficiently to effect bonding in said portions of the web, and
   e. removing said activating agent from the web.

2. The method of pattern bonding a nonwoven web made from polyamide filaments comprising
   a. advancing the web through first and second treatment zones,
   b. applying an activating agent to the web in the first treatment zone to allow the web to absorb 0.1 to 20 weight percent of the agent,
   c. applying water in vapor form to the web in the second treatment zone to allow the web to absorb sufficient moisture that the molar ratio of water to agent in the filaments in the web is above the bonding limit,
   d. advancing the web between a pair of rolls at least one of which has raised portions which contact portions of the web, said raised portions being heated sufficiently to drive off sufficient moisture to effect bonding in said portions of the web, and
   e. removing said activating agent from the web.

3. The method of claim 2 wherein the web absorbs 0.5 to 6 ight percent of the agent.

4. The method of claim 3 wherein the agent is in gaseous form and is selected from the group consisting of hydrogen halides, boron trifluoride, sulfur dioxide, sulfur trioxide and a mixture of chlorine and sulfur dioxide.

5. The method of claim 4 wherein the activating agent is hydrogen chloride.

6. A product made by the process of claim 4.

7. The method of claim 4 wherein a mixture of water and the activating agent in vapor form is applied to the web in the first treatment zone to allow the web to absorb moisture and said agent on a molar ratio of about 1:1.

8. The method of claim 7 wherein the web has a weight of 4 to 400 g/m² before advancing through said treatment zones.

9. A product made by the process of claim 8.

10. The method of claim 8 wherein the web has a weight of 10 to 150 g/m² before advancing through said treatment zones.

11. The method of pattern bonding a nonwoven web made from filaments having polyamide surface portions, comprising
   a. advancing the web through first and second treatment zones,
   b. applying an activating agent selected from the group consisting of the hydrogen halides, boron trifluoride, sulfur dioxide, sulfur trioxide and a mixture of chlorine and sulfur dioxide, to the web in the first treatment zone to allow the web to absorb 0.5 to 6 weight percent of the activating agent,
   c. applying water in vapor form to the web in the second treatment zone to allow the web to absorb sufficient moisture that the molar ratio of water to activating agent in the filaments in the web is above the bonding limit,
   d. advancing the web between a pair of rolls at least one of which has raised portions which contact portions of the web, said raised portions being heated sufficiently to drive off sufficient moisture to effect bonding in said portions of the web, and
   e. removing said activating agent from the web.

12. The method of claim 11 wherein the filaments are side-by-side bicomponent filaments with one of the components being polaymide.

13. The method of claim 11 wherein the filaments are sheath/core filaments with the sheath component being polyamide.

14. A product made by the method of claim 11.

* * * * *